US012703403B2

(12) United States Patent
Okazaki

(10) Patent No.: US 12,703,403 B2
(45) Date of Patent: Aug. 11, 2026

(54) CONVEYOR CARRIER

(71) Applicant: NAKANISHI METAL WORKS CO., LTD., Osaka (JP)

(72) Inventor: Yoshihiro Okazaki, Osaka (JP)

(73) Assignee: NAKANISHI METAL WORKS CO., LTD., Osaka (JP)

( * ) Notice: Subject to any disclaimer, the term of this patent is extended or adjusted under 35 U.S.C. 154(b) by 70 days.

(21) Appl. No.: 18/810,997

(22) Filed: Aug. 21, 2024

(65) Prior Publication Data

US 2025/0074477 A1 Mar. 6, 2025

(30) Foreign Application Priority Data

Aug. 30, 2023 (JP) ..... 2023-139609
Jun. 5, 2024 (JP) ..... 2024-091458

(51) Int. Cl.
*B61B 12/04* (2006.01)
*B61B 10/00* (2006.01)

(52) U.S. Cl.
CPC ..... *B61B 12/04* (2013.01); *B61B 10/00* (2013.01)

(58) Field of Classification Search
CPC ..... B61B 12/04; B61B 10/00
See application file for complete search history.

(56) References Cited

U.S. PATENT DOCUMENTS 3,894,629 A * 7/1975 Wakabayashi ..... B65G 19/265 198/732
4,428,299 A * 1/1984 Wakabayashi ..... B61B 10/025 104/96
2004/0200795 A1* 10/2004 Summa ..... B61B 10/00 213/62 R
2016/0107711 A1* 4/2016 Okazaki ..... B65G 17/002 198/793
2017/0313521 A1* 11/2017 Okamura ..... B65G 19/265
2020/0072716 A1* 3/2020 Okazaki ..... G01M 13/023

FOREIGN PATENT DOCUMENTS

CN 110775879 A * 2/2020 ..... B66F 9/06
GB 2178386 A * 2/1987 ..... B61B 10/025
JP 2541673 B2 10/1996
JP 2003212111 A * 7/2003
JP 2003276815 A * 10/2003
JP 2018052133 A * 4/2018 ..... B65G 35/06

* cited by examiner

*Primary Examiner* — Gene O Crawford
*Assistant Examiner* — Abby A Jorgensen
(74) *Attorney, Agent, or Firm* — Kratz, Quintos & Hanson, LLP

(57) ABSTRACT

A conveyor carrier includes a front end trolley that is a free trolley having an engagement dog that engages with a traction dog of a power chain drive device, and a connection rod located between the front end trolley and an object support unit. The connection rod includes a front division body and a rear division body. The front division body and the rear division body are supported by a slide support unit so as to be relatively slidable in a front-rear direction. A shock absorber in the front-rear direction is disposed between the front division body and the rear division body. The connection rod has a side surface that serves as a drive surface with which a friction roller of a friction roller drive device is in pressure contact.

7 Claims, 10 Drawing Sheets

CONVEYOR CARRIER

FIELD

The present invention relates to a conveyor carrier that moves along a conveyance route defined by a guide rail.

BACKGROUND

In a power-and-free conveyor, a carrier that supports an object to be conveyed may be caused to stop in a fixed position, or subsequent carriers may be caused to successively stop following the stopped carrier in a storage line, for example. In such a situation, there is a first problem that a large impact acts on the carriers and noise is generated (see Patent Literature (PTL) 1, for example).

In the power-and-free conveyor of PTL 1, a load bar (30) connected to a traction trolley (32) in the carrier incorporates an air damper (39) for solving the first problem described above.

CITATION LIST

Patent Literature

[PTL] Japanese Patent No. 2541673

SUMMARY

Technical Problem

The power-and-free-conveyor uses a power chain drive device. This configuration causes a second problem, in addition to the first problem, that noise is generated when the power chain is driven, and lubricating oil, which is essential to prevent wear, contaminates objects to be conveyed and an area around the conveyor.

Due to the first and second problems in the power-and-free conveyors, there is a need of gradually replacing power-and-free conveyors with friction roller conveyors that can solve the problems. For addressing the need, it is necessary to allow the carrier to be used in common with the power-and-free conveyor and the friction roller conveyor. To achieve such common use, it is necessary for the carrier to be driven by both the power chain drive device and a friction roller drive device.

As described above, it is necessary to provide the carrier with a drive surface with which a friction roller can be in pressure contact, and is also necessary to solve the first problem when the carrier is used in the power-and-free conveyor.

An object of the present invention is to provide a carrier that can be used in common with power-and-free conveyors and friction roller conveyors while mitigating a large impact acting on the carrier when used in the power-and-free conveyors.

Solution to Problem

A conveyor carrier according to a first aspect of the present invention includes an object support unit that supports an object to be conveyed, and moves along a conveyance route defined by a guide rail. The conveyor carrier includes: a front end trolley that is a free trolley supported and guided by the guide rail, and has an engagement dog for engaging with a traction dog of a power chain drive device; and a connection rod located between the front end trolley and the object support unit. The connection rod includes a front division body and a rear division body. The front division body and the rear division body are supported by a slide support unit, to be relatively slidable in a front-rear direction. A shock absorber in the front-rear direction is disposed between the front division body and the rear division body. The connection rod has a side surface serving as a drive surface with which a friction roller of a friction roller drive device is in pressure contact.

In a configuration of the conveyor carrier according to the first aspect, the front end trolley, which is a free trolley, has the engagement dog for engaging with the traction dog of a power chain drive device. Accordingly, the carrier can be driven by the power chain drive device. The connection rod has a side surface serving as a drive surface with which a friction roller of a friction roller drive device is in pressure contact. Accordingly, the carrier can be driven by the friction roller drive device. Therefore, the carrier can be used in common with the power-and-free conveyor and the friction roller conveyor.

In addition, in the configuration of the conveyor carrier according to the first aspect, the connection rod includes the front division body and the rear division body, the front division body and the rear division body are supported by the slide support unit to be relatively slidable in the front-rear direction, and the shock absorber in the front-rear direction is disposed between the front division body and the rear division body. Thus, the connection rod has an extendable/contractable function, and an attenuation force is generated by the shock absorber. Therefore, a large impact acting on the carrier when the carrier is used in the power-and-free conveyor can be mitigated, and generation of noise can be prevented. Furthermore, the front division body and the rear division body are supported by the slide support unit so as to be relatively slidable in the front-rear direction. Therefore, even if the shock absorber is damaged during conveyance of the carrier, the extendable/contractable function of the connection rod can be maintained. Therefore, there is no need to stop the conveyance of the carrier.

In a conveyor carrier according to a second aspect of the present invention in the conveyor carrier according to the first aspect, the shock absorber is incorporated in the connection rod.

In a configuration of the conveyor carrier according to the second aspect, the shock absorber is incorporated in the connection rod. Therefore, an axis connecting attachment holes in a front and a rear of the connection rod and a center axis of the shock absorber can be brought closer and laid to overlap each other. Therefore, a bending moment applied to the shock absorber is reduced, so that mitigation of the impact by the shock absorber can be directly and efficiently performed.

In a configuration of the conveyor carrier according to the second aspect, the shock absorber is incorporated in the connection rod. Even if oil is leaked from the shock absorber, the leakage of the oil from the connection rod can be prevented, thereby avoiding adhesion of the oil to the friction roller. Therefore, a coefficient of friction between the carrier and the friction roller does not decrease, so that the carrier can be reliably conveyed by the friction roller drive device.

In a conveyor carrier according to a third aspect in the conveyor carrier according to the first aspect, the connection rod has the side surface with a portion that changes a shape thereof when the front division body and the rear division body relatively slide in the front-rear direction, the shape being a stepped shape that forms: first front-rear opposing surfaces each extending substantially downward from an upper end of the connection rod; top-bottom opposing surfaces each extending in the front-rear direction from a lower end of a corresponding one of the first front-rear opposing surfaces; and second front-rear opposing surfaces each extending substantially downward from an end portion of a corresponding one of the top-bottom opposing surfaces, and when the friction roller is in pressure contact with the drive surface in the side surface of the connection rod, the friction roller is in pressure contact with one of the front division body and the rear division body, both the front division body and the rear division body, and a remaining one of the front division body and the rear division body, in stated order.

In a configuration of the conveyor carrier according to the third aspect, the connection rod has the side surface with the portion that changes its shape when the front division body and the rear division body relatively slide in the front-rear direction, and the shape is the stepped shape. When the friction roller is in pressure contact with the drive surface on the side surface of the connection rod, the friction roller is in pressure contact sequentially with one of the front division body and the rear division body, both of them, and the other one of them, in this order. Therefore, even when the extension/contraction stroke of the connection rod is elongated, the drive surface with which the friction roller is in pressure contact can be secured.

In a conveyor carrier according to a fourth aspect of the present invention in the conveyor carrier according to the first aspect, the slide support unit is configured such that guide pins respectively provided at a front and a rear of one of the front division body and the rear division body are inserted through long holes in the front-rear direction provided at a front and a rear of a remaining one of the front division body and the rear division body, the slide support unit is placed above or below the drive surface with which the friction roller is in pressure contact, and a slide stroke of the slide support unit is smaller than a stroke of the shock absorber.

In a configuration of the conveyor carrier according to the fourth aspect, the slide support unit that supports the front division body and the rear division body in a relatively slidable manner in the front-rear direction is configured such that the guide pins respectively provided at the front and the rear of one of the front division body and the rear division body are inserted through the long holes in the front-rear direction provided at the front and the rear of the other of the front division body and the rear division body. With this configuration, a structure of the slide support unit is simplified and a slide motion is ensured. Furthermore, the slide support unit is placed in above or below the drive surface with which the friction roller of a friction roller drive device is in pressure contact, so that a continuous drive surface without any irregularities can be secured. Still furthermore, a slide stroke of the slide support unit is smaller than a stroke of the shock absorber, thereby preventing damage of the shock absorber.

In a conveyor carrier according to a fifth aspect of the present invention in the conveyor carrier according to the fourth aspect, the guide pins are respectively provided at two locations to sandwich the shock absorber from the front and the rear, and the long holes are respectively provided at two locations to sandwich the shock absorber from the front and the rear.

In a configuration of the conveyor carrier according to the fifth aspect, the guide pins and the long holes, which constitute the slide support unit, are provided at the respective two locations so as to sandwich the shock absorber from the front and the rear, thereby dispersing the impact received at opposite ends of the slide support unit at a slide stroke.

In a conveyor carrier according to a sixth aspect of the present invention in the conveyor carrier according to the fifth aspect, when a distance between the guide pins respectively provided at the front and the rear is set as L1, and a distance between attachment holes respectively provided at a front and a rear of the connection rod at a time when the connection rod is in a most contracted state is set as L2, $L1>(L2/2)$ is established.

In a configuration of the conveyor carrier according to the sixth aspect, the large distance between the guide pins and the large distance between the long holes in the front and rear sides are secured. Thus, a force in the bending direction acting on the slide support unit is mitigated, thereby facilitating the extension/contraction action of the connection rod.

In a conveyor carrier according to a seventh aspect of the present invention in the conveyor carrier according to any one of the first to sixth aspects, one end of the shock absorber is attached to a cover body provided in an upper portion of one of the front division body and the rear division body.

In a configuration of the conveyor carrier according to the seventh aspect, installation of the shock absorber is completed by attaching the cover body to the upper portion of one of the front division body and the rear division body while one end of the shock absorber is attached to the cover body. Exposure of one end of the shock absorber is completed by removing the cover body. Accordingly, installation and replacement of the shock absorber is facilitated.

Advantageous Effects

As described above, the conveyor carrier according to the present invention can be used in common with power-and-free conveyors and friction-roller conveyors while mitigating a large impact acting on the carrier when used in the power-and-free conveyor.

BRIEF DESCRIPTION OF DRAWINGS

FIG. 8A shows a state in which a friction roller is in pressure contact only with a front division body, FIG. 8B shows a state in which the friction roller is in pressure contact with both the front division body and a rear division body, and FIG. 8C shows a state in which the friction roller is in pressure contact only with the rear division body.

DESCRIPTION OF EMBODIMENTS

Hereinafter, embodiments according to the present invention are described with reference to the drawings.

In the description, along a conveyance direction of a conveyor carrier (see an arrow F in FIGS. 1 and 2), a front side (downstream side) of the conveyor carrier is defined as a front, a rear side (upstream side) thereof is defined as a rear, left and right are defined facing the front, and a view from the left is referred to as a front view.

[Conveyor Carrier]

Figure 1:
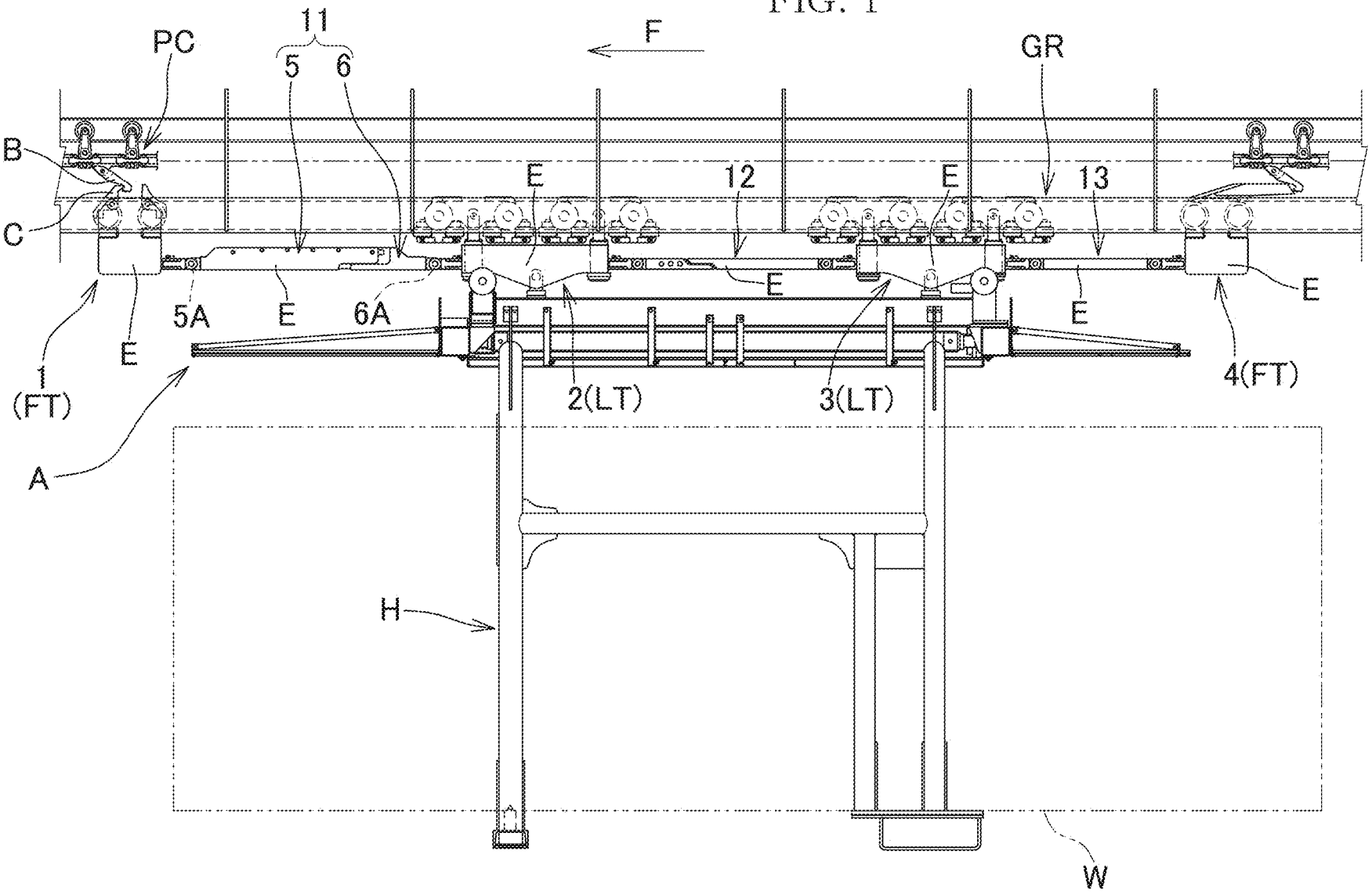
FIG. 1 is a front view showing an example in which a conveyor carrier according to an embodiment of the present invention is used in an overhead conveyor.
Figure 2:
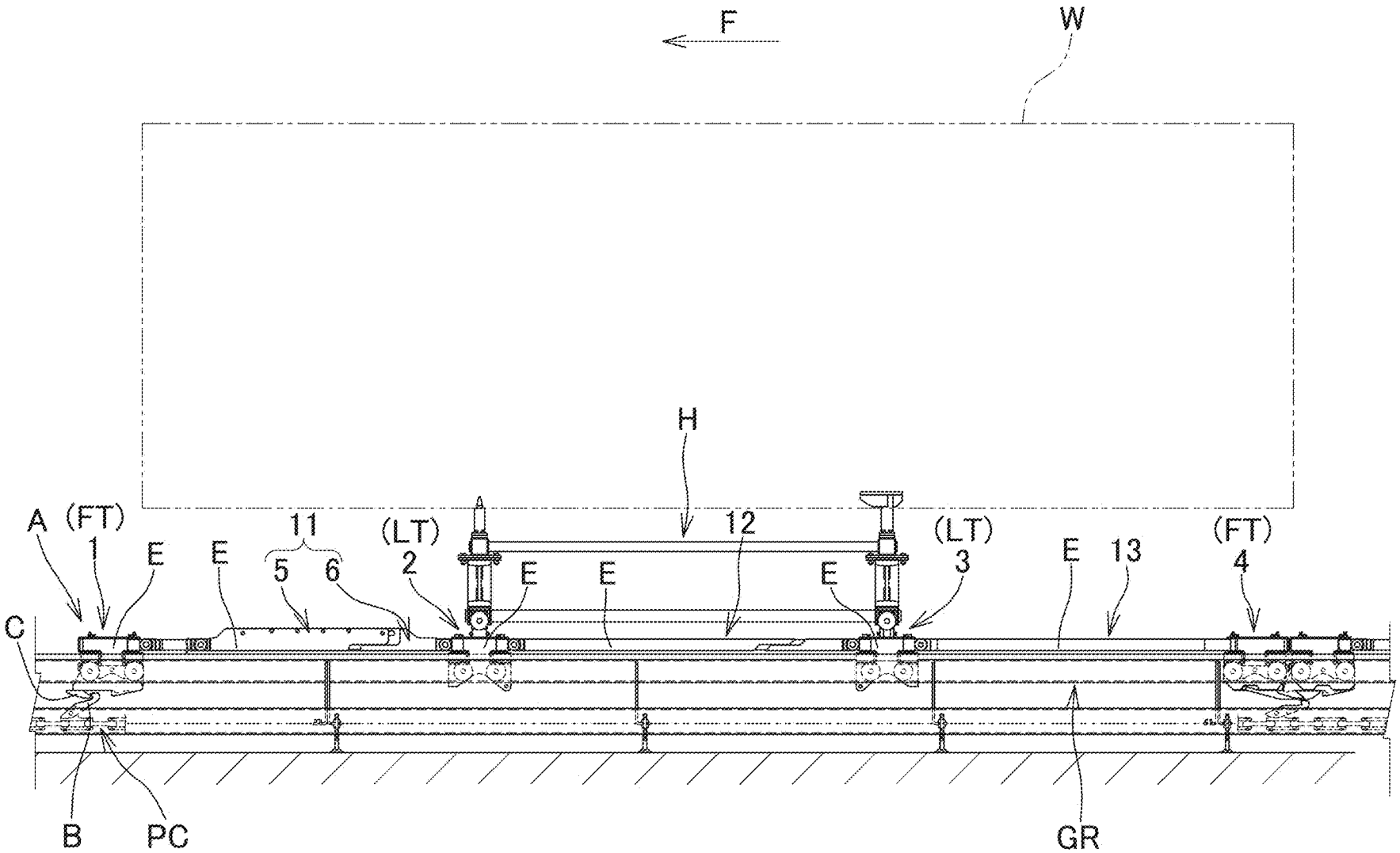
FIG. 2 is a front view showing an example in which the conveyor carrier according to the embodiment of the present invention is used in a floor conveyor.

FIG. 1 shows an example in which a conveyor carrier A according to an embodiment of the present invention is used in an overhead conveyor. FIG. 2 shows an example in which the conveyor carrier A is used in a floor conveyor. The carrier A includes an object support unit H for supporting an object W to be conveyed, and moves along a conveyance route defined by a guide rail GR.

The carrier A shown in FIGS. 1 and 2 includes load trolleys LT that support the object support unit H, and free trolleys FT that do not support the object support unit H. The load trolleys LT and the free trolleys FT are supported and guided by the guide rail GR.

The carrier A includes, for example, a front end trolley 1 that is the free trolley FT, a front load trolley 2 and a rear load trolley 3 that are the load trolleys LT, and a rear end trolley 4 that is the free trolley FT.

The front end trolley 1 and the front load trolley 2 are connected via the first connection rod 11. The front load trolley 2 and the rear load trolley 3 are connected via a second connection rod 12. The rear load trolley 3 and the rear end trolley 4 are connected via a third connection rod 13.

The front end trolley 1 has an engagement dog C that engages with a traction dog B of a power chain drive device PC. With this configuration, the carrier A can be driven by the power chain drive device PC.

Each of the front end trolley 1, the first connection rod 11, the front load trolley 2, the second connection rod 12, the rear load trolley 3, the third connection rod 13, and the rear end trolley 4 has a side surface that serves as a drive surface E with which a friction roller D (see FIGS. 8A to 8C) of the friction roller drive device FR is in pressure contact. In other words, the carrier A has a side surface over its entire length in the front-rear direction, and the side surface serves as the drive surface E with which the friction roller D of the friction roller drive device FR is in pressure contact. With this configuration, the carrier A can be driven by the friction roller drive device FR.

Therefore, the carrier A can be used in common with the power-and-free conveyor and the friction roller conveyor.

It is not necessarily required that the side surface of the carrier A over its entire length in the front-rear direction is used as the drive surface E. However, when the side surface over the entire length of the carrier A in the front-rear direction is used as the drive surface E, an interval between the friction rollers D to be placed can be enlarged. Accordingly, the number of friction rollers D can be reduced, so that a cost of the friction roller drive device FR can be reduced.

[First Connection Rod]

As shown in FIGS. 1 and 2, the first connection rod 11 includes a front division body 5 and a rear division body 6. The front division body 5 and the rear division body 6 are supported by a slide support unit S shown in FIGS. 3 to 7 so as to be relatively slidable in the front-rear direction. With this configuration, the first connection rod 11 can be extended and contracted between its most extended state shown in FIGS. 3 and 5 and its most contracted state shown in FIGS. 4 and 6.

Figure 7:
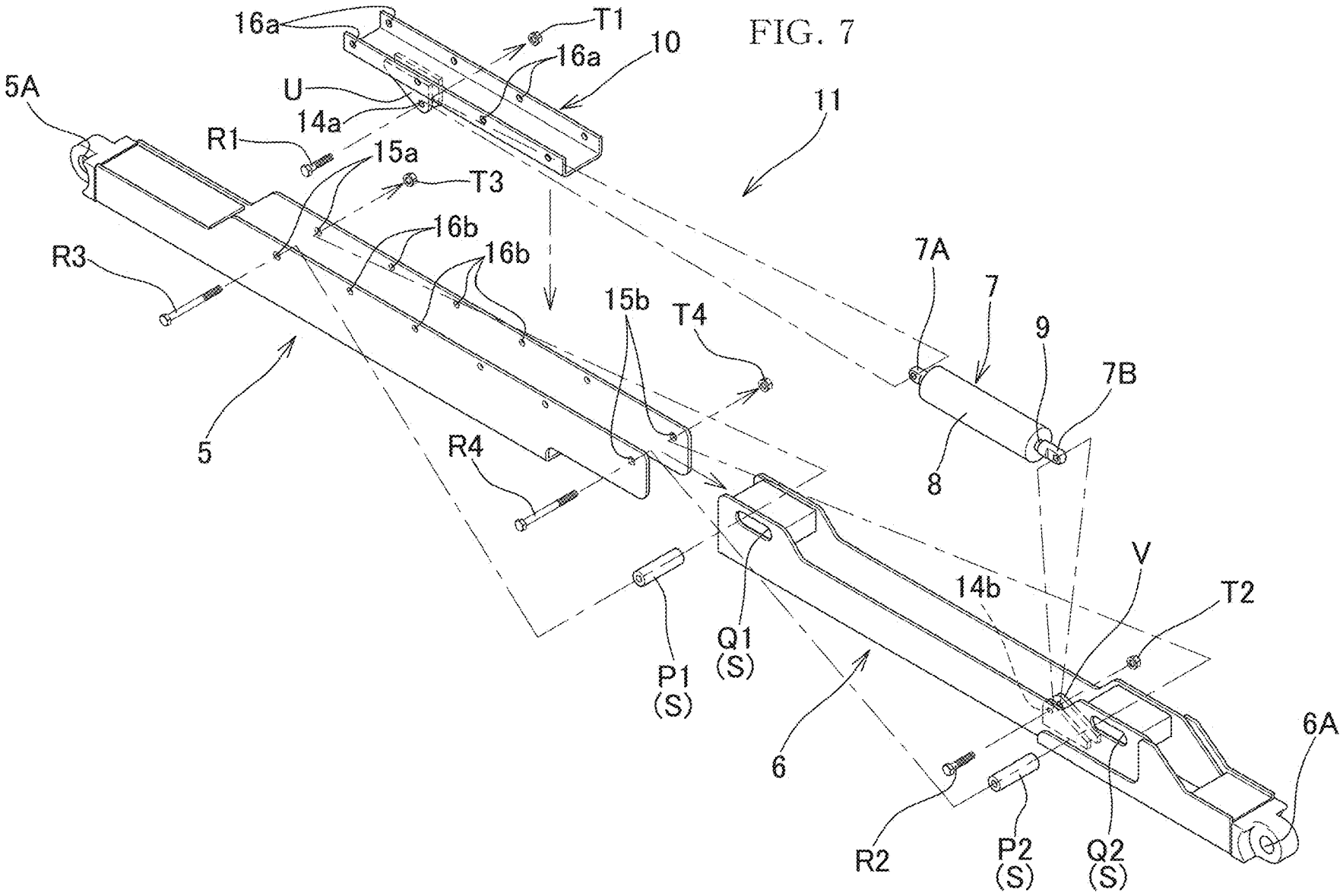
FIG. 7 is an exploded perspective view of the first connection rod.

With reference to the exploded perspective view of FIG. 7, a configuration of the first connection rod 11 according to the present embodiment is described. The first connection rod 11 is an example of connection rods constituting the conveyor carrier according to the present invention.

A bolt R1 is inserted through a through hole 14*a* provided in the left side of a support body U hanging from a cover body 10, a through hole of an end portion 7A of the shock absorber 7, and another through hole 14*a* provided in the right side of the support body U, and then a nut T1 is screwed onto a tip end of the bolt R1. Accordingly, the end portion 7A of the shock absorber 7 is attached to the cover body 10.

A bolt R2 is inserted through a through hole 14*b* provided in the left side of a support body V of the rear division body 6, a through hole of an end portion 7B of the shock absorber 7, and another through hole 14*b* provided in the right side of the support body V, and then a nut T2 is screwed onto a tip end of the bolt R2. Accordingly, the end portion 7B of the shock absorber 7 is attached to the rear division body 6.

A cylindrical guide pin P1 is inserted through a long hole Q1 elongated in the front-rear direction of the rear division body 6, and a cylindrical guide pin P2 is inserted through a long hole Q2 elongated in the front-rear direction of the rear division body 6. A bolt R3 is inserted through a through hole 15*a* provided in the left side of the front division body 5, a center hole of the guide pin P1, and another through hole 15*a* provided in the right side of the front division body 5, and then a nut T3 is screwed onto a tip end of the bolt R3. A bolt R4 is inserted through a through hole 15*b* provided in the left side of the front division body 5, a center hole of the guide pin P2, and another through hole 15*b* provided in the right side of the front division body 5, and then a nut T4 is screwed onto a tip end of the bolt R4. Accordingly, the front division body 5 and the rear division body 6 are supported so as to be relatively slidable in the front-rear direction.

Figure 3:
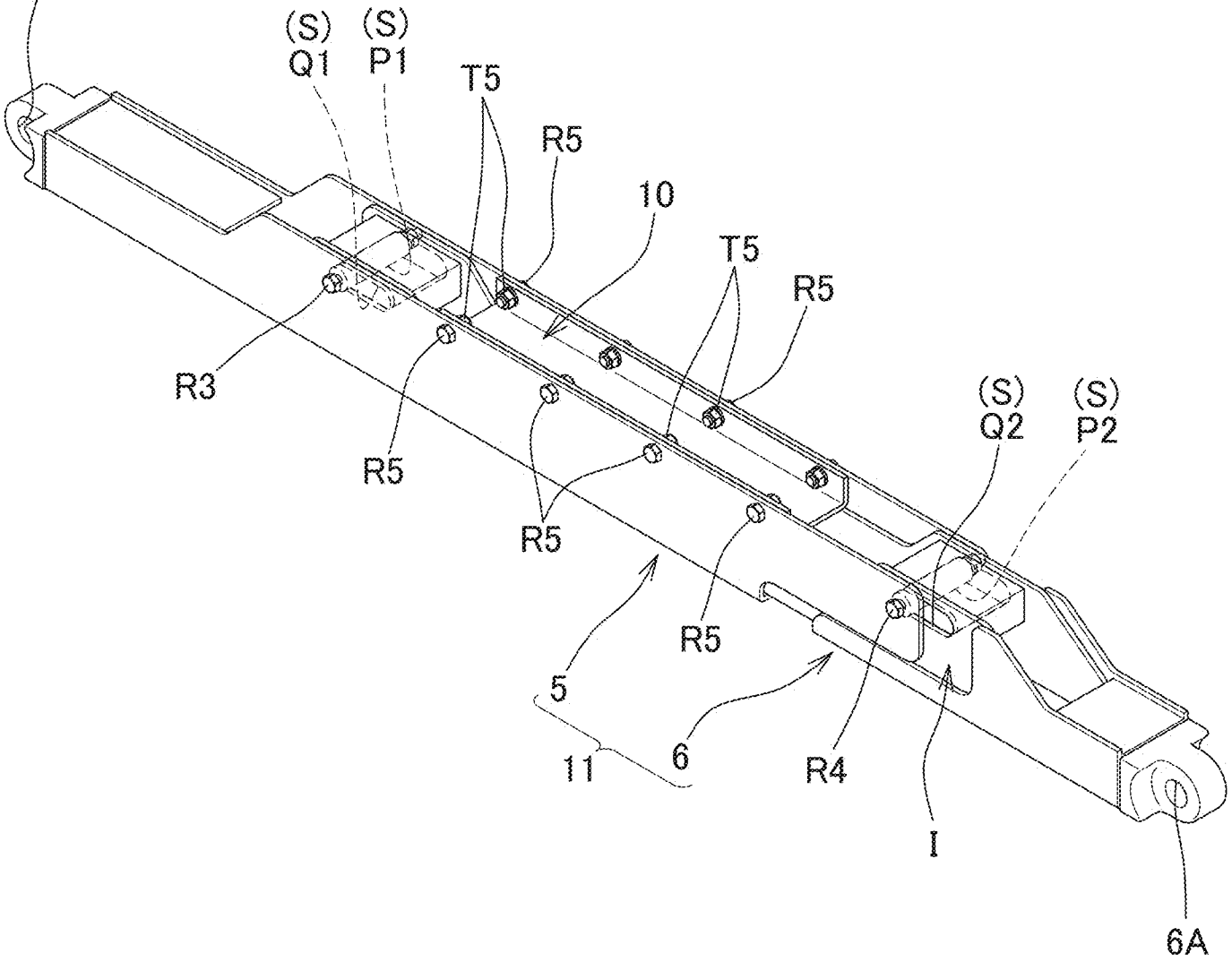
FIG. 3 is a perspective view of a first connection rod in the conveyor carrier according to the embodiment of the present invention, showing the first connection rod in its most extended state.
Figure 4:
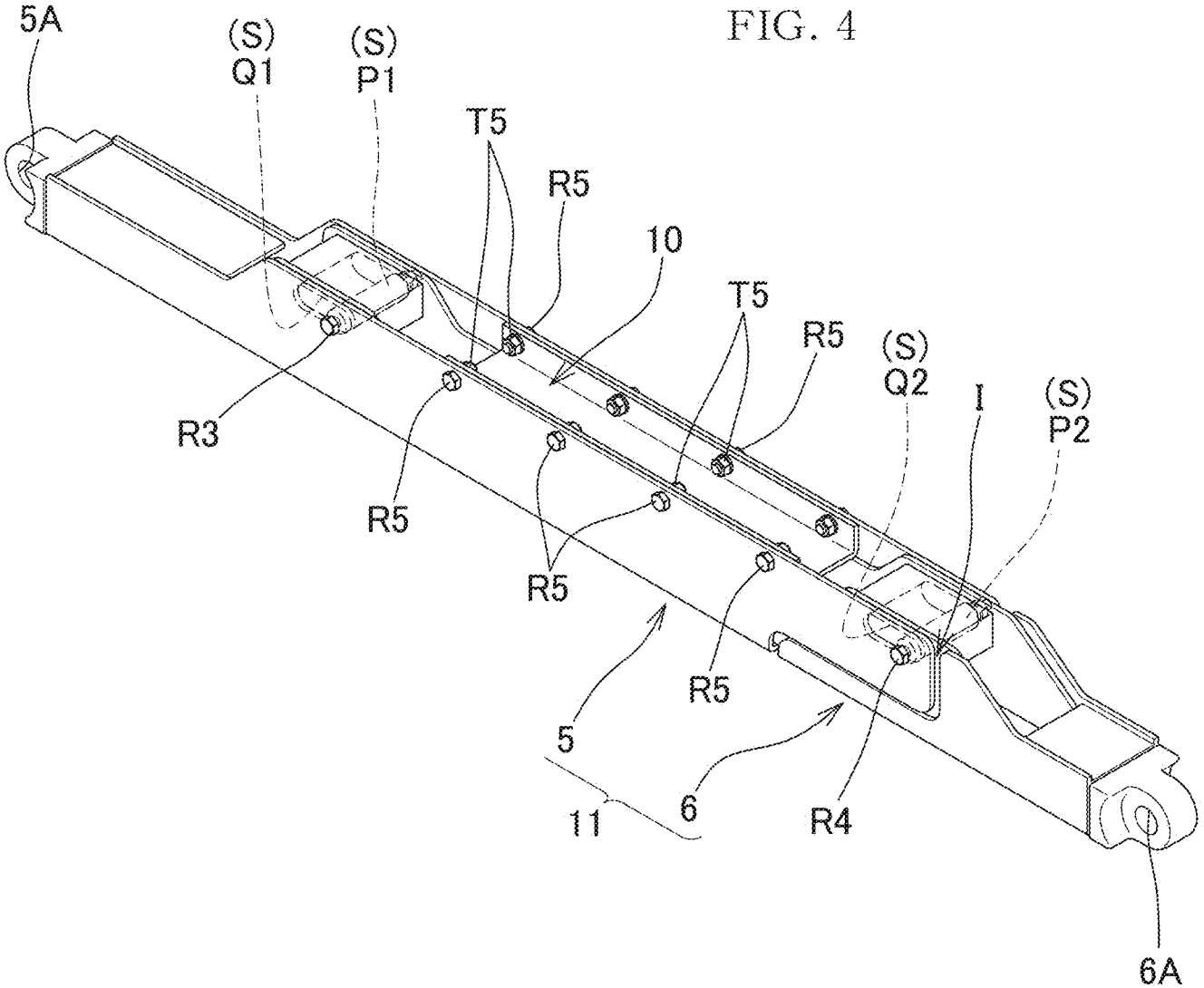
FIG. 4 is a perspective view of the first connection rod in its most contracted state.

Bolts R5 in the left side in FIGS. 3 and 4 are respectively inserted into through holes 16*b* in the left side of the front division body 5 shown in FIG. 7 and through holes 16*a* in the left side of the cover body 10, and then a nut T5 in the left side in FIGS. 3 and 4 is screwed onto the tip end of each of the left-side bolts R5. Bolts R5 in the right side in FIGS. 3 and 4 are respectively inserted into through holes 16*b* in the right side of the front division body 5 shown in FIG. 7 and through holes 16*a* in the right side of the cover body 10, and then a nut T5 in the right side in FIGS. 3 and 4 is screwed onto the tip of each of the right-side bolts R5. Accordingly, the cover body 10 is attached to the front division body 5.

In this manner, the end portion 7A of the shock absorber 7 is attached to the cover body 10 provided on an upper portion of one of the front division body 5 and the rear division body 6 (the front division body 5 in the present embodiment). Accordingly, installation of the shock absorber 7 is completed by attaching the cover body 10 to the upper portion of the front division body 5 while the end portion 7A of the shock absorber 7 is attached to the cover body 10. Exposure of the end portion 7A of the shock absorber 7 is completed by removing the cover body 10. Accordingly, installation and replacement of the shock absorber 7 is facilitated.

[Slide Support Unit]

In the slide support unit S, for example, the guide pins P1 and P2 respectively provided at the front and the rear of one of the front division body 5 and the rear division body 6 (the front division body 5 in the present embodiment) are respectively inserted into the long holes Q1, Q2 in the front-rear direction respectively provided at the front and the rear of the other of the front division body 5 and the rear division body 6 (the rear division body 6 in the present embodiment). The slide support unit S is configured with the guide pins P1, P2 and the long holes Q1, Q2, so that a structure of the slide support unit S is simplified, and sliding action is ensured.

The slide support unit S is disposed above the drive surface E with which the friction roller D (see FIGS. 8A to 8C) of the friction roller drive device FR comes into pressure contact. This ensures the continuous drive surface E without any irregularities. The slide support unit S may be disposed below the drive surface E with which the friction roller D is in pressure contact.

[Shock Absorber]

Figure 5:
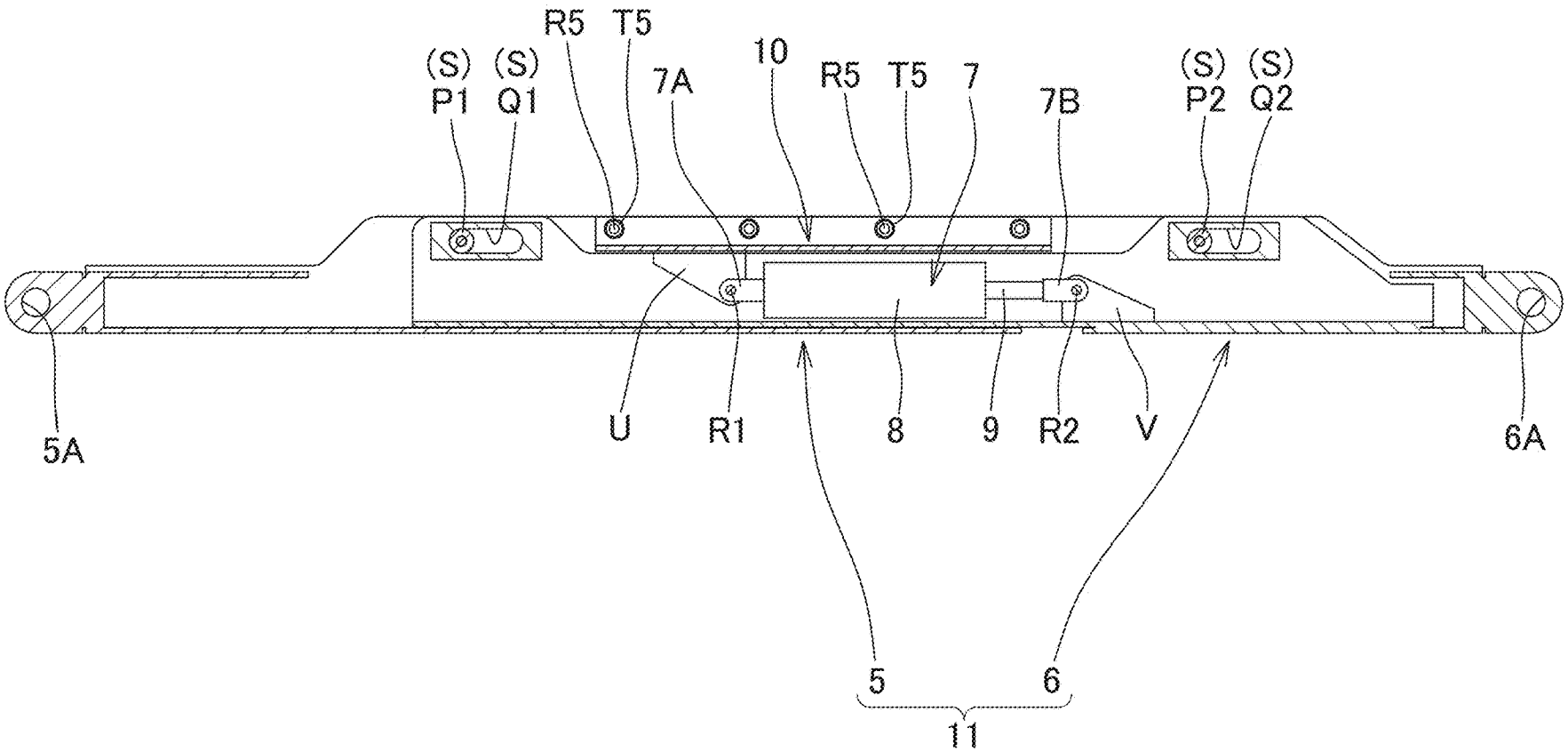
FIG. 5 is a front view of a vertical cross-section of the first connection rod in its most extended state.
Figure 6:
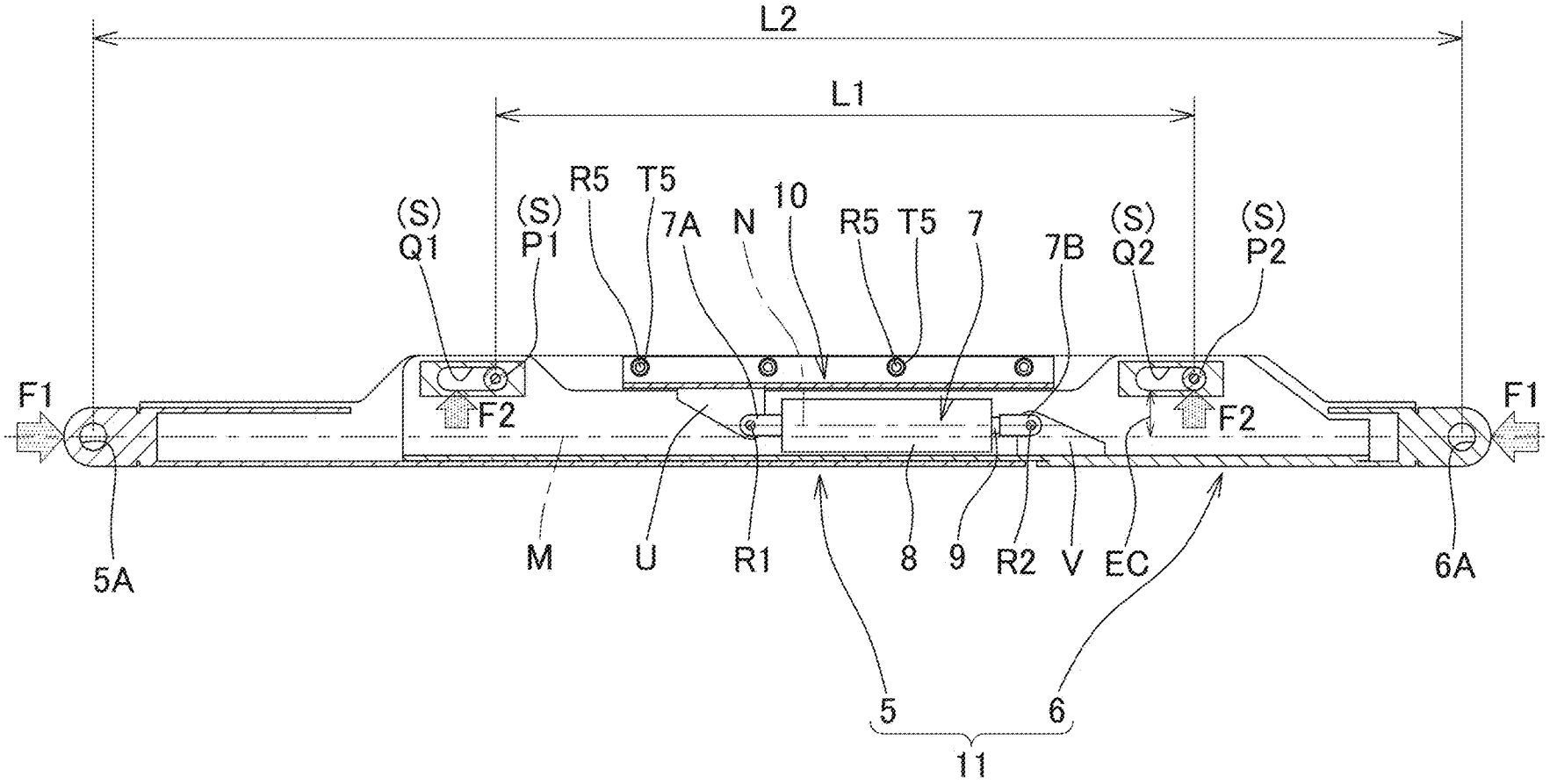
FIG. 6 is also a front view of a vertical cross-section of the first connection rod in its most contracted state.

As shown in FIGS. 5 to 7, the shock absorber 7 is disposed in the front-rear direction between the front division body 5 and the rear division body 6. The shock absorber 7 is, for example, a telescopic double-acting hydraulic damper including a cylinder tube 8, oil contained in the cylinder tube, and a piston rod 9, thereby adjusting its speed in both extension/contraction directions. Therefore, when the first connection rod 11 extends or contracts to cause the shock absorber 7 to generate an attenuation force, the impact can be mitigated.

As shown in FIGS. 5 to 7, the shock absorber 7 is incorporated in the first connection rod 11. With this configuration, an axis M connecting front and rear attachment holes 5A, 6A of the first connection rod 11 shown in FIG. 6 can be brought closer to a central axis N of the shock absorber 7, and the axis M and the central axis N can be laid to overlap each other. Therefore, a bending moment acting on the shock absorber 7 is reduced, so that the shock absorber 7 can directly and efficiently absorb the impact.

In addition, the shock absorber 7 is incorporated in the first connection rod 11. Accordingly, even if oil leaks from the shock absorber 7, oil leakage from the first connection rod 11 can be prevented, thereby preventing adhesion of the oil to the friction roller D. Therefore, a coefficient of friction between the carrier A and the friction roller D does not decrease, so that the carrier A can be reliably conveyed by the friction roller drive device FR.

[Arrangement of Slide Support Unit]

As shown in FIGS. 5 and 6, the respective guide pins P1, P2 and the respective long holes Q1, Q2, which constitute the slide support unit S, are provided at two locations so as to sandwich the shock absorber 7 from the front and the rear. With this configuration, impact received at both ends of the slide support unit S at a slide stroke can be dispersed.

[Slide Stroke]

The slide stroke of the slide support unit S is set to be smaller than a stroke of the shock absorber 7. This can prevent damage to the shock absorber 7.

[Distance Between Front and Rear Guide Pins, and Distance Between Front and Rear Long Holes]

When a distance between the front and rear guide pins P1, P2 of the first connection rod 11 is L1, and a distance between the front and rear attachment holes 5A, 6A of the first connection rod 11 at a time when the first connection rod 11 shown in FIG. 6 is in a most contracted state is L2, L1>(L2/2) can be established.

In the present embodiment, as described above, in order to secure the drive surface E with which the friction roller D (see FIGS. 8A to 8C) of the friction roller drive device FR is in pressure contact, the slide support unit S is disposed above the drive surface E, for example. With this configuration, when the first connection rod 11 extends or contracts, a force acts on the slide support unit S in the vertical direction.

For example, referring to FIG. 6, when the first connection rod 11 contracts, a rearward force F1 is applied to the front division body 5 and an upward force F2 is applied to the guide pin P2, and also a forward force F1 is applied to the rear division body 6 and the upward force F2 is applied to the long hole Q1. When eccentricity in an upward direction from the axis M, which is shown in FIG. 6, is EC, equation (1) can be obtained.

$$F1 \times EC = F2 \times L1 \quad (1)$$

When the eccentricity amount EC cannot be changed, as a premise, due to a fixed height of the drive surface E, it is necessary to increase L1 for reducing the upward force F2 (the bending force acting on the slide support unit S). In the present embodiment, the distance L1 between the front and rear guide pins P1, P2 and the distance between the front and rear long holes Q1, Q2 are large, so that the bending force acting on the slide support unit S is mitigated, thereby facilitating the extension/contraction action of the first connection rod 11.

[Part Having Side Shape that Changes Due to Extension/Contraction of First Connection Rod]

Figure 8A:
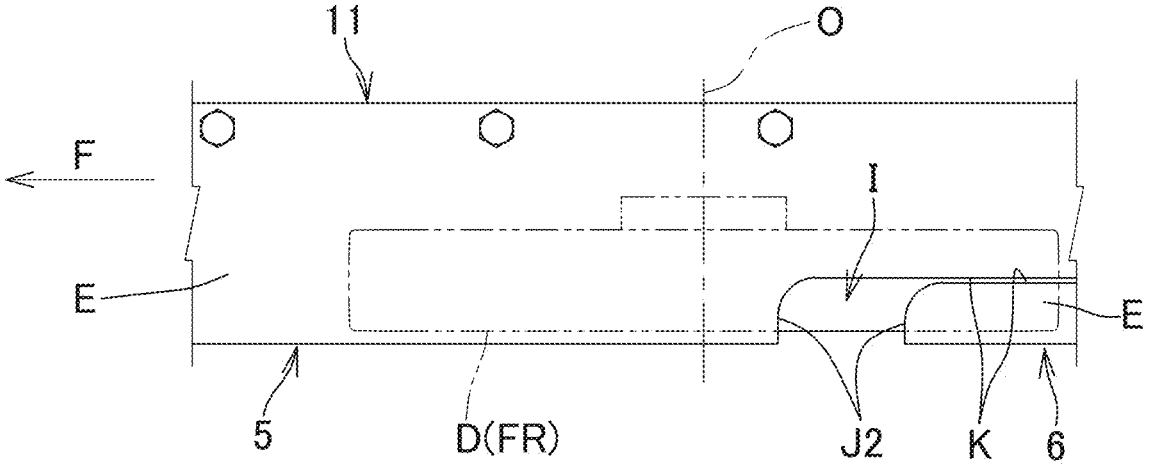
FIGS. 8A to 8C are front views of enlarged main parts, showing a state in which the first connection rod is driven by a friction roller drive device.
Figure 8B:
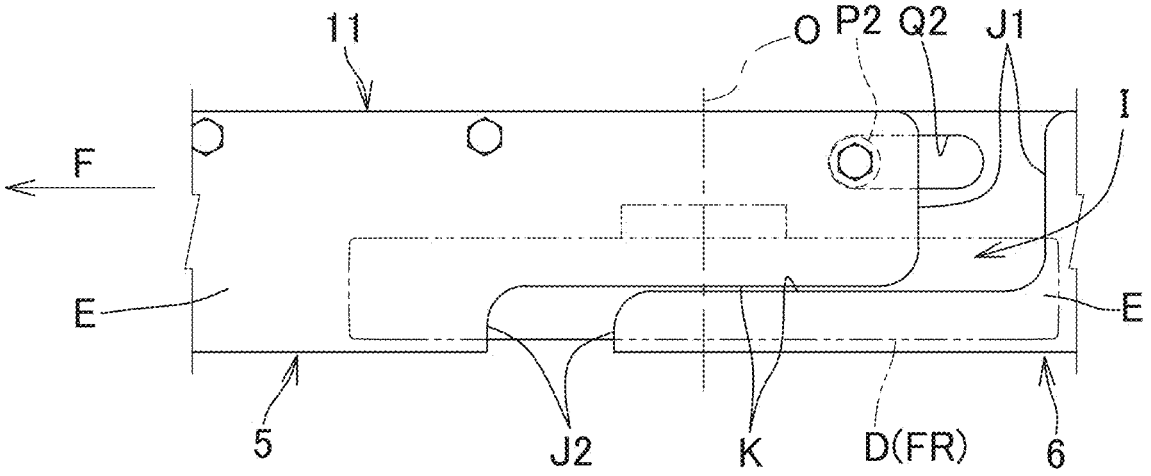
Figure 8C:
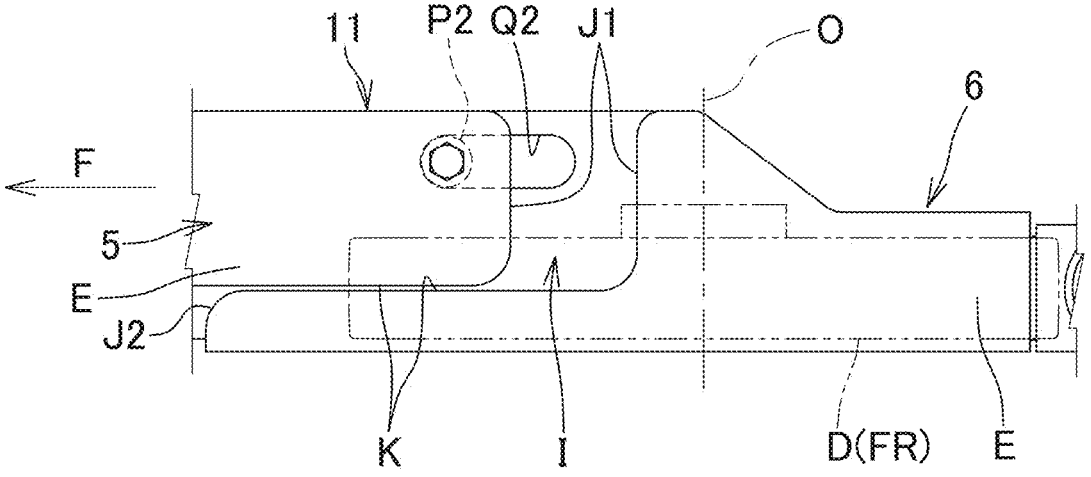

The friction roller D of the friction roller drive device FR, which is shown by phantom lines in FIGS. 8A to 8C, rotates about a rotation axis O and is in pressure contact with the drive surface E of the first connection rod 11. With this configuration, the first connection rod 11 (the conveyor carrier A) is conveyed in the conveyance direction F in FIGS. 8A to 8C.

As shown in FIGS. 8A to 8C, a portion I on a side surface of the first connection rod 11 has a shape that changes when the first connection rod 11 extends or contracts, i.e., when the front division body 5 and the rear division body 6 relatively slide in the front-rear direction. Such a portion I has a stepped shape that forms first front-rear opposing surfaces J1 extending substantially downward from an upper end of the first connection rod 11, a top-bottom opposing surfaces K respectively extending in the front-rear direction from a lower end of each of the first front-rear opposing surfaces J1, and a second front-rear opposing surfaces J2 extending substantially downward from each end of the top-and-bottom opposing surfaces K.

Accordingly, when the friction roller D of the friction roller drive device FR is in pressure contact with the drive surface E on the side surface of the first connection rod 11, the friction roller D is first in pressure contact only with the front division body 5, as shown in FIG. 8A. Then, the friction roller D is in pressure contact with both the front division body 5 and the rear division body 6, as shown in FIG. 8B. Then, the friction roller D is in pressure contact only with the rear division body 6, as shown in FIG. 8C. Therefore, even when the extension/contraction stroke of the first connection rod 11 is elongated, the drive surface E with which the friction roller D is in pressure contact can be secured.

In the configuration of the conveyor carrier A according to the embodiment of the present invention, the first connection rod 11 is formed of the front division body 5 and the rear division body 6, the front division body 5 and the rear division body 6 are supported by the slide support unit S so as to be relatively slidable in the front-rear direction, and the shock absorber 7 in the front-rear direction is provided between the front division body 5 and the rear division body 6.

With this configuration, the first connection rod 11 has an extension/contraction function and an attenuation force is generated by the shock absorber 7. Accordingly, it is possible to mitigate a large impact acting on the carrier A when the carrier A is used in a power-and-free conveyor, and also to prevent the generation of noise. In addition, the front division body 5 and the rear division body 6 are supported by the slide support unit S so as to be relatively slidable in the front-rear direction. Therefore, even if the shock absorber 7 is damaged during conveyance of the carrier A, the extension/contraction function of the first connection rod 11 can be maintained. Therefore, there is no need to stop the conveyance of the carrier A.

Modified Example of Shock Absorber

The "shock absorber in the front-rear direction" in the present invention is not limited to the shock absorber 7 that is the telescopic double-acting hydraulic damper. For example, two single-acting hydraulic dampers, the speed of which can be adjusted in a compression direction, may be combined. An example of the combination of a first shock absorber 17A that is the single-acting hydraulic damper and a second shock absorber 17B that is also the single-acting hydraulic damper is shown in FIGS. 9 and 10.

Figure 9:
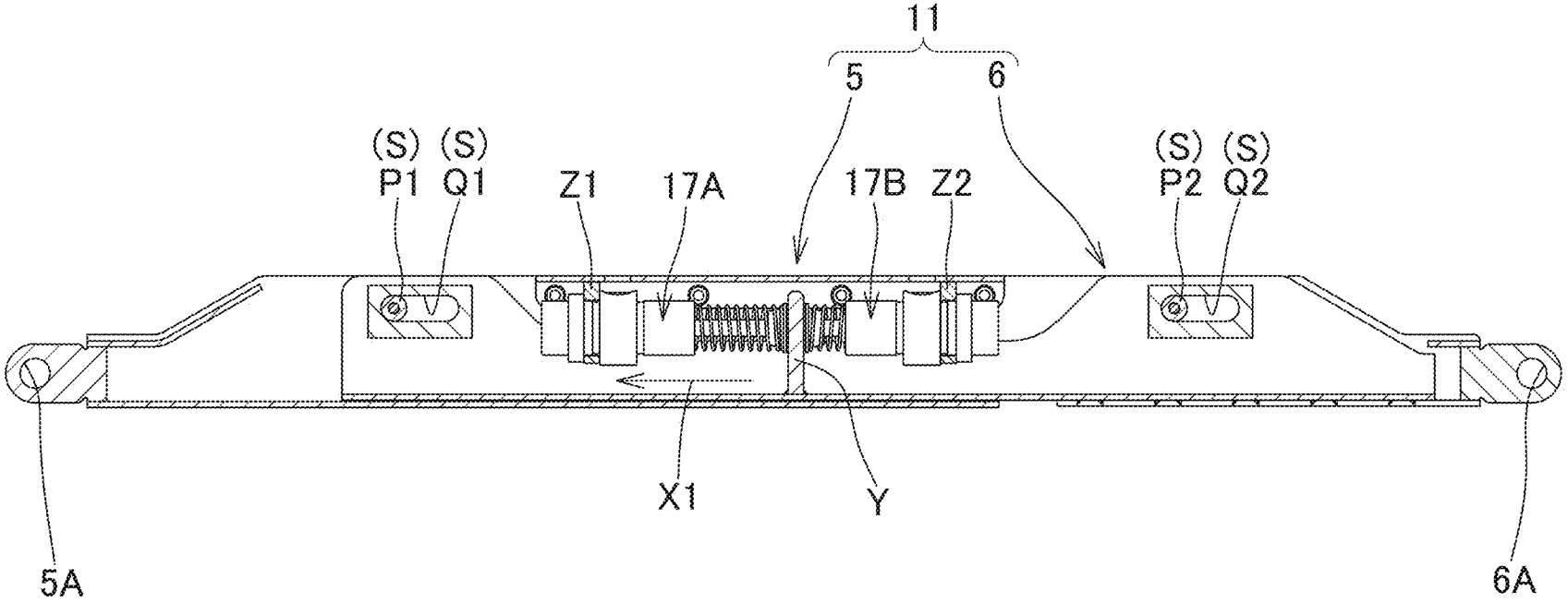
FIG. 9 is a front view of a vertical cross-section of a modified example of a shock absorber to be used in the first connection rod, showing the first connection rod in its most extended state.
Figure 10:
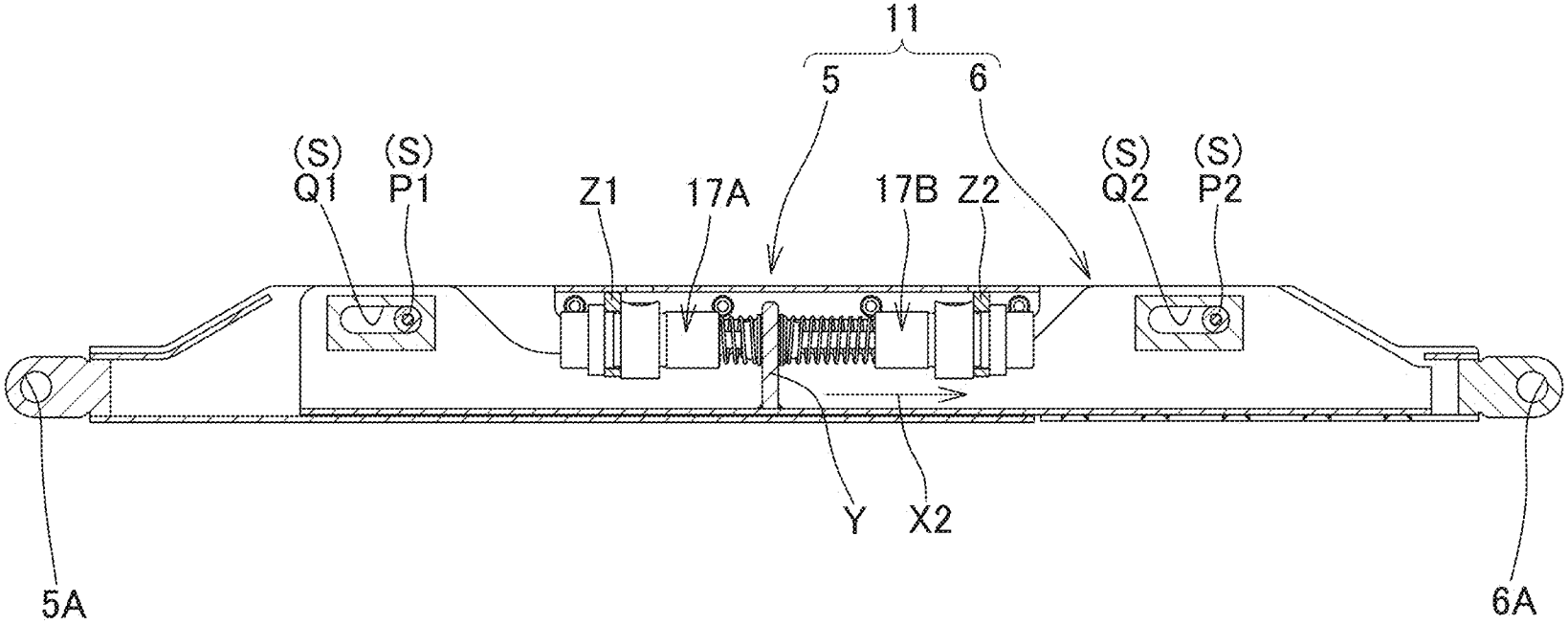
FIG. 10 is a front view of a vertical cross-section of the modified example, showing the first connection rod in its most contracted state.

In FIGS. 9 and 10, the first shock absorber 17A is supported by a first support body Z1 provided in the front division body 5, and the second shock absorber 17B is supported by a second support body Z2 provided in the front division body 5. The shock absorbers 17A, 17B face each other in the front-rear direction, and a receiving plate Y attached to the rear division body 6 is disposed between the shock absorbers 17A, 17B.

For example, when the conveyor carrier A shown in FIG. 1 is stopped at a fixed position, a compression force acts on the first connection rod 11 shown in FIG. 9, and the receiving plate Y interposed between the shock absorbers 17A and 17B shifts in the conveyance direction F (a direction X1 along which the first shock absorber 17A in FIG. 9 is compressed). Therefore, the attenuation force is generated by the first shock absorber 17A that is the single-acting hydraulic damper capable of adjusting its speed in the compression direction and is compressed to a state shown in FIG. 10 from a state shown in FIG. 9.

For example, when the engagement dog C of the conveyor carrier A shown in FIG. 1 engages with the towing dog B and the conveyor carrier A is towed by the power chain drive device PC, an extension force acts on the first connection rod 11 shown in FIG. 10, and the receiving plate Y interposed between the shock absorbers 17A and 17B shifts in the direction opposite to the conveying direction F (a direction X2 in FIG. 10 in which the second shock absorber 17B is compressed). Therefore, an attenuation force is generated by the second shock absorber 17B that is the single-acting hydraulic damper capable of adjusting its speed in the compression direction and is compressed to the state shown in FIG. 9 from the state shown in FIG. 10.

The above description of the embodiments is merely illustrative, and the present invention is not limited thereto. Various improvements and changes can be made without departing from the scope of the invention.

The invention claimed is:

1. A conveyor carrier that includes an object support unit that supports an object to be conveyed, and moves along a conveyance route defined by a guide rail, the conveyor carrier capable of being driven by both a power chain drive device and a friction roller drive device, the conveyor carrier comprising:

a front end trolley that is a free trolley supported and guided by the guide rail, and has an engagement dog for engaging with a traction dog of the power chain drive device; and a connection rod located between the front end trolley and the object support unit, wherein the connection rod includes a front division body and a rear division body, the front division body and the rear division body are supported by a slide support unit, to be relatively slidable in a front-rear direction, a shock absorber in the front-rear direction is disposed between the front division body and the rear division body, and the connection rod has a side surface serving as a drive surface with which a friction roller of the friction roller drive device is in pressure contact.

2. The conveyor carrier according to claim 1, wherein the shock absorber is incorporated in the connection rod.

3. The conveyor carrier according to claim 1, wherein the connection rod has the side surface with a portion that changes a shape thereof when the front division body and the rear division body relatively slide in the front-rear direction, the shape being a stepped shape that forms: first front-rear opposing surfaces each extending substantially downward from an upper end of the connection rod; top-bottom opposing surfaces each extending in the front-rear direction from a lower end of a corresponding one of the first front-rear opposing surfaces; and second front-rear opposing surfaces each extending substantially downward from an end portion of a corresponding one of the top-bottom opposing surfaces, and when the friction roller is in pressure contact with the drive surface in the side surface of the connection rod, the friction roller is in pressure contact with one of the front division body and the rear division body, both the front division body and the rear division body, and a remaining one of the front division body and the rear division body, in stated order.

4. The conveyor carrier according to claim 1, wherein the slide support unit is configured such that guide pins respectively provided at a front and a rear of one of the front division body and the rear division body are inserted through long holes in the front-rear direction provided at a front and a rear of a remaining one of the front division body and the rear division body, the slide support unit is placed above or below the drive surface with which the friction roller is in pressure contact, and a slide stroke of the slide support unit is smaller than a stroke of the shock absorber.

5. The conveyor carrier according to claim 4, wherein the guide pins are respectively provided at two locations to sandwich the shock absorber from the front and the rear, and the long holes are respectively provided at two locations to sandwich the shock absorber from the front and the rear.

6. The conveyor carrier according to claim 5, wherein when a distance between the guide pins respectively provided at the front and the rear is set as L1, and a distance between attachment holes respectively provided at a front and a rear of the connection rod at a time when the connection rod is in a most contracted state is set as L2, $L1>(L2/2)$ is established.

7. The conveyor carrier according to claim 1, wherein one end of the shock absorber is attached to a cover body provided in an upper portion of one of the front division body and the rear division body.

* * * * *